United States Patent [19]

Yamamoto

[11] Patent Number: 4,766,825

[45] Date of Patent: Aug. 30, 1988

[54] PIN-TUCKING DEVICE IN PIN TUCK SEWING MACHINE

[75] Inventor: Masaya Yamamoto, Shijonawate, Japan

[73] Assignee: Morimoto Mfg. Co., Ltd., Osaka, Japan

[21] Appl. No.: 29,865

[22] Filed: Mar. 24, 1987

[30] Foreign Application Priority Data

Sep. 19, 1986 [JP] Japan ..... 61-144226[U]

[51] Int. Cl.[4] ..... D05B 35/08; A41H 43/00

[52] U.S. Cl. ..... 112/146; 223/34

[58] Field of Search ..... 112/144, 145, 146; 223/28–36

[56] References Cited

U.S. PATENT DOCUMENTS

| | | | |
|---|---|---|---|
| 1,024,317 | 4/1912 | Douglas | 223/34 X |
| 2,328,927 | 9/1943 | Seaman | 112/144 X |
| 2,948,241 | 8/1960 | Wyndham | 223/34 X |
| 3,657,742 | 4/1972 | Gittin | 223/34 X |
| 4,266,700 | 5/1981 | Wakasono | 112/144 X |

FOREIGN PATENT DOCUMENTS

| | | | |
|---|---|---|---|
| 453462 | 3/1975 | U.S.S.R. | 223/34 |

*Primary Examiner*—H. Hampton Hunter

*Attorney, Agent, or Firm*—Koda and Androlia

[57] ABSTRACT

In a pin-tucking device for forming a plurality of pleats-like folds on a fabric, guide-plate mounting plates have comb-like kerfs for engaging and disengaging hook portions of guide plates so that guide plates may be varied in number to change the intervals of the pleats-like folds in various different ways. Frame shaped based plates permit easy removal of fabric jamming or the like trouble without the necessity of the base plates being put out of assembly. The guide-plate mounting plates are mounted to the base plates by fixing plates. The device is easy to manufacture and economical.

4 Claims, 5 Drawing Sheets

PIN-TUCKING DEVICE IN PIN TUCK SEWING MACHINE

BACKGROUND OF THE INVENTION

1. Field of the Invention:

This invention relates to a pin-tucking device for folding a fabric in a pleated-like pattern at desired intervals in transverse relation to the direction of advance of the fabric at a stage prior to sewing by a sewing machine for sewing pin tucks.

2. Prior Art:

Generally, pin-tucking devices of this kind are so designed that a fabric is passed through a gap defined between a pair of guide plates, being thereby squeezed to have pleat-like folds formed thereon. If pleat-like folds are to be formed in a specified number and at given intervals, such device has a plurality of pairs of guide plates arranged in position.

One known type of such pin-tucking device has pairs of guide plates fixed integrally to upper and lower base plates by welding or otherwise. Another known type has such guide plates removably held in engagement with engagement grooves formed in upper and lower base plates.

The pin-tucking device of the former type has a difficulty that since it forms pleat-like folds on the fabric at uniform intervals, the guide plates have to be replaced together with the base plates if it is desired to change the intervals, and therefore that base plates having various different dimensions have to be prepared so as to meet needs for such change in intervals. As such, this known type is not economical. Furthermore, the fact that the guide plates are integral with the base plates requires that, if said intervals are to be changed without the base plates being replaced, sewing needles must be disposed correspondingly to the desired intervals of folds, instead of the intervals of folds formed by the pin-tucking device being changed, so that when tucks are actually formed on the fabric by sewing, some of the folds remain unstitched, it being thus necessary to carry out a post-stitching operation for removing such unstitched folds, in which respect the known type is far from being said to be of practical use.

The known pin-tucking device of the latter type, which has guide plates held in engagement with the engagement grooves in the base plates, has on one hand an advantage that the intervals of the pleat-like folds may be changed by suitably removing one of any particular pair of guide plates, but on the other hand it has a drawback that a multiplicity of engagement grooves of a particular configuration corresponding to that of guide plates must be formed in both of the base plates which are metal or synthetic resin made, which fact requires special machine tools and elaborate machining, thus involving high cost.

In aforesaid conventional devices, the upper base plate is made of transparent resin so as to facilitate early visual detection of any possible fabric lodging in the gap between a pair of guide plates while the fabric being passed through the gap, as well as of any irregularity present in the fabric, but the trouble is that such fabric lodging or fabric irregularity, if detected, cannot be removed unless the upper- and lower-base plate assembly is disassembled.

SUMMARY OF THE INVENTION

This invention, made in view of the above difficulties with the prior art, has as its object the provision of a pin-tucking device which permits easy changing of the intervals of the pleat-like folds formed on a fabric, and yet can eliminate any possible fabric jamming on lodging or fabric irregularity without the necessity of disassembling the base plate assembly, and which is inexpensive to construct with less machining work involved.

The aforesaid object is accomplished by the arrangement in accordance with the invention, which comprises a frame-shaped base plate, guide-plate mounting plates mounted individually to front and rear of the base plate, fixing plate connected to respective one sides of the guide-plate mounting plates in surface contact relation, and a required number of guide plates mounted over a space between the guide-plate mounting plates, said guide-plate mounting plates each having a required number of comb tooth-shaped kerfs spaced from one another in transverse relation to the direction of movement of the fabric to be sewn, said guide plates including parallel plate portions each having a first hook portion which is fitted in one of the kerfs of the front guide plate mounting plates and thereby locked in position and which is fixed to said guide plate mounting plate by being pressed thereagainst by said fixing plate, and radial plate portions individually extending at specified angles from said parallel plate portions to said rear guide plate mounting plate, said radial plate portions each having a second hook portion which is fitted in one of the kerfs of the rear guide plate mounting plates and thereby locked in position and which is fixed to said guide plate mounting plate by being pressed thereagainst by said fixing plate.

According to the pin-tucking device constructed as above, the first hook portion of each guide plate is fitted in one of the kerfs of the front guide plate mounting plates and thereby locked in position and the second hook portion of each guide plate is fitted in one of the base end-side guide plate mounting plates and thereby locked in position, whereby the individual guide plates are arranged in position on the base plate. Therefore, individual guide plates may be dismounted by removing the fixing plate and guide plate mounting plates. As such, the pin-tucking device according to the invention permits easy removal and mounting of any of the guide plates and easy variation of intervals of pleats-like folds on the fabric to be sewn in various different ways. The construction of the base plate requires less machining work and the kerfs in the guide plate mounting plates are of a simple comb-tooth type; therefore, the device of the invention is easier and less expensive to manufacture than conventional types of pin-tucking devices in which base plates having engagement grooves or guide plates fixed by welding to base plates are employed, and provides a definite economical advantage.

Furthermore, the fact that the base plate is of a frame shape permits easy visual detection of fabric jamming or fabric irregularity through the base plate and correction of such troubles by hand or with the air of a bar or the like, thus saving any trouble or time loss which may be otherwise involved in eliminating fabric jamming or fabric irregularity by disassembling the base plate assembly.

BRIEF DESCRIPTION OF THE DRAWINGS

FIG. 1 is an exploded view in perspective of a lower base plate-side assembly;

FIG. 2 is a plan view thereof;

FIG. 3 is an exploded view in perspective of an upper base plate-side assembly;

FIG. 4 is a plan view thereof;

FIG. 5 is a sectional view in side elevation of the lower base plate-side assembly;

FIG. 6 is a sectional view in side elevation of the upper base plate-side assembly;

FIG. 7 is a sectional side view showing the upper and lower base plates in assembled condition.

DETAILED DESCRIPTION OF THE PREFERRED EMBODIMENTS

One embodiment of the invention will now be described with reference to the accompanying drawings.

The embodiment represents a pin-tucking device for forming folds A' on a fabric A to be sewn up by a sewing machine for sewing pin tucks (not shown) to which the invention is applied.

Figure 1:
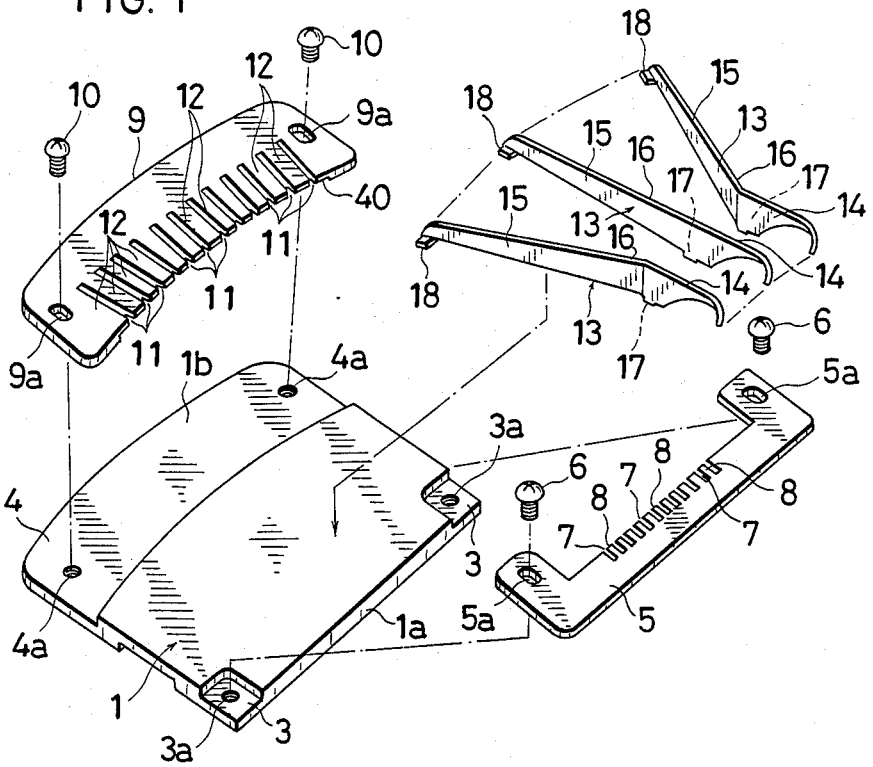
FIGS. 1 through 7, inclusive, illustrate one embodiment of the invention.
Figure 2:
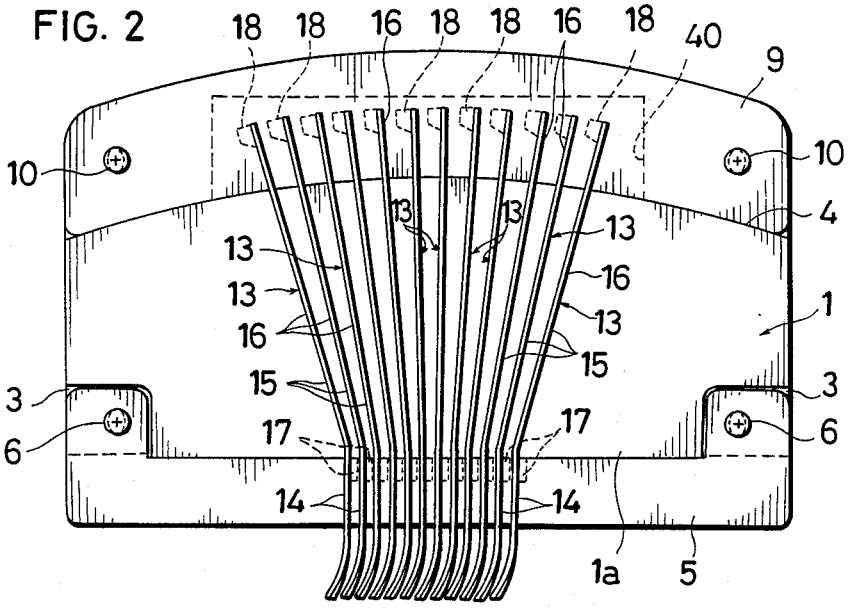
Figure 5:
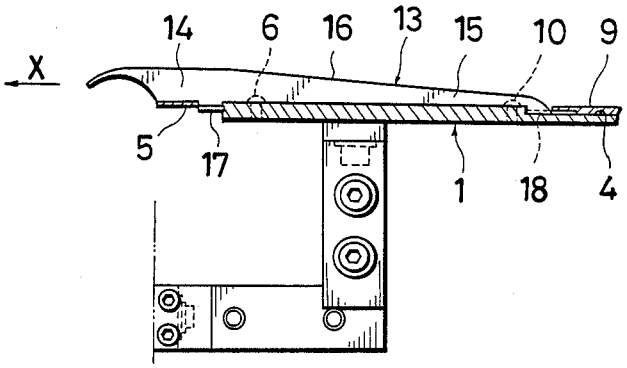

Referring to FIGS. 1, 2, and 5, numeral 1 designates a lower base plate comprised of a metal member which is generally rectangular in its planar configuration, with stepped portions 3, 4 informed respectively in its top surface and in its front, at both sides, and in its Top and in its rear portion. On the stepped portion 3 there is mounted a front edge guide plate mounting plate 5 in flush relation with the Top surface of lower base plate 1 through screws 6, 6. The screws 6, 6 are in thread engagement with threaded holes 3*a*, 3*a* in the stepped portion 3 through elongate holes 5*a*, 5*a* in the front edge guide plate mounting plate 5 at both sides thereof. At the rear portion of the front edge guide plate mounting plate 5 there are formed a suitable numbers of kerfs 7 and comb teeth 8 in transversely spaced apart relation to the direction of fabric movement X. The intervals of the comb teeth 8 correspond to the intervals of sewing needles (not shown).

At the stepped portion 4 there is mounted a rear edge guide plate mounting plate 9 through screws 10, 10 in flush relation with the top surface. The screws 10, 10 are in thread engagement with threaded holes 4*a*, 4*a* in the stepped portion 4 through elongate holes 9*a*, 9*a* in the guide plate mounting plate 9 at both sides thereof. At the front portion of the guide plate mounting plate 9, that is, at the opposite side of the front edge guide plate mounting plate 5 there are formed suitable numbers of kerfs 11 and comb teeth 12 in transverse relation to the direction of fabric movement X and at wider intervals than those of the kerfs 7 in the guide plate mounting plate 5. A recessed portion 40 is formed in the bottom surface rear edge guide plate mounting plate 9 so that the comb toothed portion 12 is thinner than the other portion of the plate 9.

A required number of first guide plate 13 extending between the two guide plate mounting plates 5 and 9 are mounted in a raised condition on the lower base plate 1. The first guide plates 13, being metal plates having a specified thickness, comprise parallel plate portions 14 arranged in spaced apart parallel relation at the front edge 1*a* of the lower base plate 1, and the radial plate portions 15 continued from the parallel plate portions 14 and extend toward the rear edge 1b of the lower base plate 1 at specified angles, first fabric fold guide edges 16 being formed by continued upper edges of the parallel plate portions 14 and radial plate portions 15. The parallel plate portion 14 of each guide plate 13 has a first hook portion 17 of L-shape integrally formed thereon and which is fitted in one of the kerfs 7 in the front edge guide plate mounting plate 5 and locked in position by comb teeth 8. The radial plate portion 15 of each guide plate 13 has a second hook portion of L-shape which is fitted into one of the kerfs 11 of in the rear edge guide plate mounting plate 9, and locked in position by comb teeth 12, said second hook portion being pressed in position between the stepped portion 4 and the recess 40.

The kerfs 7, 11 in the guide plate mounting plates 5, 9 are slightly larger in width than the thickness of the guide plates 13.

Figure 3:
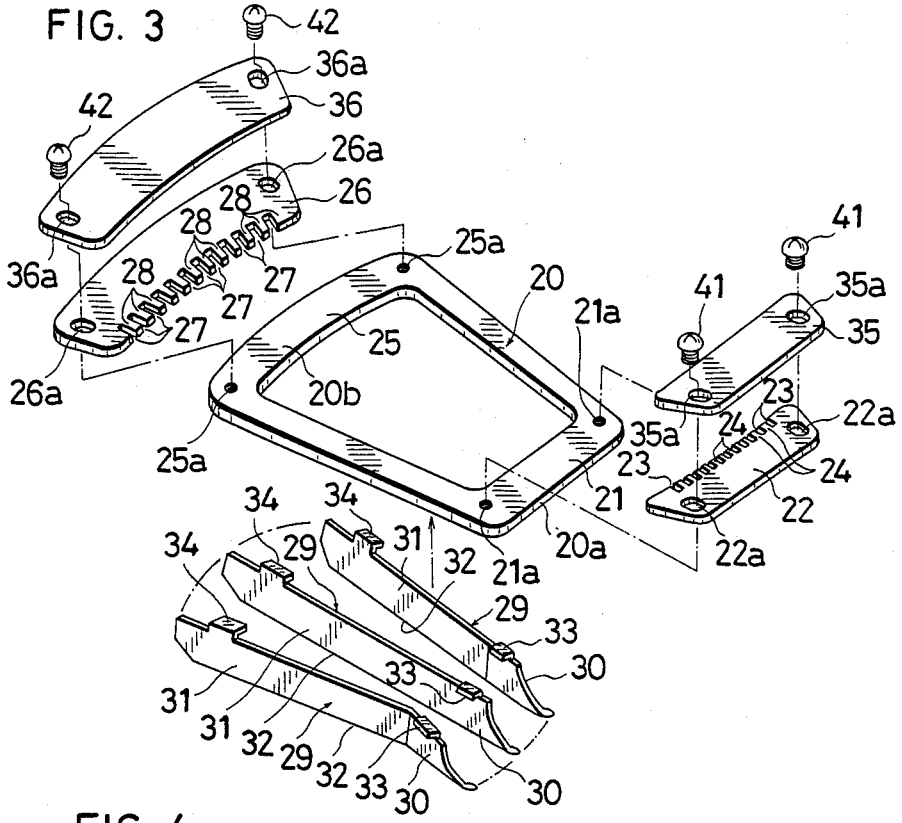
Figure 4:
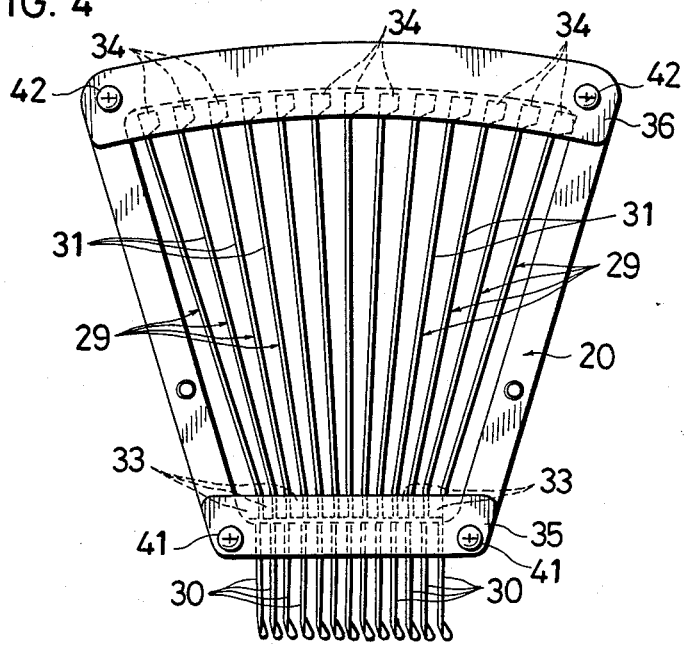
Figure 6:
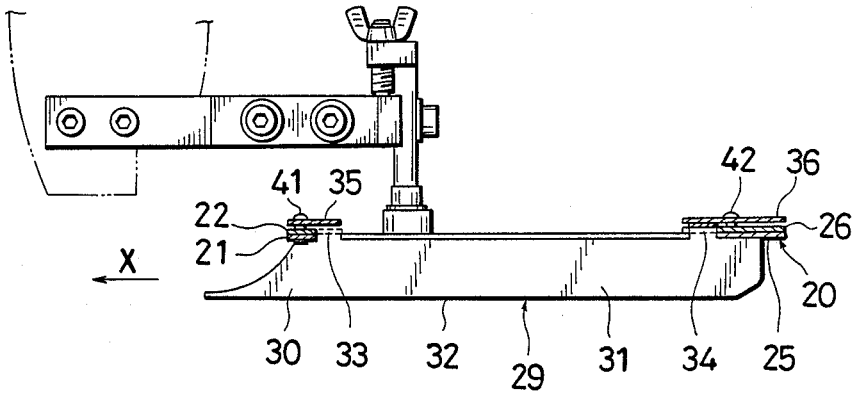

Referring to FIGS. 3, 4, and 6, numeral 20 designates an upper base plate, which is a thick metal-made member having a frame contour of a trapezoidal like configuration, for example. On the front portion 21 of the upper base plate 20 there are placed a guide plate mounting plate 22 and a fixing plate 35 in that order, the both plates being mounted in position through screws 41, 41. The screws 41, 41 are in thread engagement with threaded holes 21*a*, 21*a* in the front portion 21 through elongate holes 22*a*, 22*a*, 35*a*, 35*a* at both sides of the guide mounting plate 22 and fixing plate 35. At the rear portion of the guide plate mounting plate 22, a suitable numbers of kerfs 23 and comb teeth 24 are arranged in transversely spaced apart relation to the direction of fabric movement X. It is noted in this connection that the kerfs 23 and comb teeth 24 are positioned within the frame. On the rear portion 25 of the upper base plate 20 there are placed a rear guide plate mounting plate 26 and a fixing plate 36 in that order, the both plates being mounted in position through screws 42, 42. The screws 42, 42 are in thread engagement with threaded holes 25*a*, 25*a* in the rear portion 25 through elongate holes 26*a*, 26*a*, 36*a*, 36*a* at both sides of the guide plate mounting plate 26 and fixing plate 36. At the front portion of the rear guide plate mounting plate 26, kerfs 27 and comb teeth 28 are arranged in transverse relation to the direction of fabric movement X and at greater intervals than those of the kerfs 23 in the front portion guide plate mounting plate 22. It is noted in this connection that the kerfs 27 and comb teeth 28 are position within the frame of the upper base plate 20.

The kerfs 23, 28 in the guide plate mounting plates 22, 26 are slightly larger in width than the thickness of second guide plates 29 which are to be described hereinafter. Second guide plate 29 extending between the front and rear guide plate mounting plates 22, 26 are arranged in a raised but downwardly slanted position on the upper base plate 20.

The guide plates 29, being metal plates having a specified thickness, comprise parallel plate portions 30 positioned in spaced parallel relation at the front edge 20*a* of the upper base plate 20, and radial plate portions 31 continued from the parallel plate portions 30 and extending toward the rear edge 20*b* of the upper base plate 20 of a specified angle, the continual lower edges of the parallel and radial plate portions 30 and 31 defining fold guide edges 32 for the fabric. Each of the parallel plate portions 30 of the guide plates 29 has a first hook portion 33 of L-shape integrally formed therewith which is fitted in one of the kerfs 23 of the front guide plate mounting plate 22 and engaged by comb teeth 24. The first hook portion 33 is pressed in position between the front guide plate mounting plate 22 and the fixing plate 35. Each of the radial plate portions 31 of the guide plates 29 has a second hook portion 34 of L-shape integrally formed therewith which is fitted in one of the kerfs 27 of the guide plate mounting plate 26 and engaged by comb teeth 28. The second hook portion 34 is pressed in position between the guide plate mounting plate 26 and the fixing plate 36.

Figure 7:
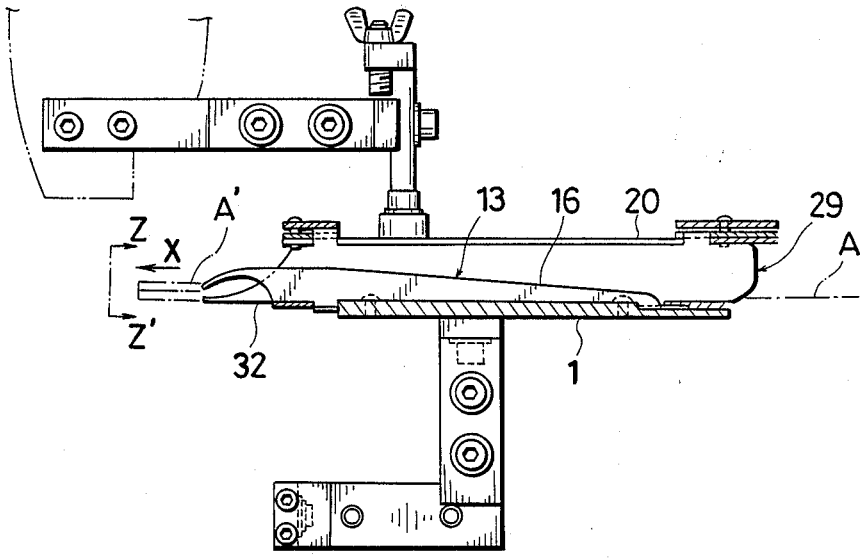

Through such arrangement, as FIG. 7 shows, the second guide plates 29 of the upper base plate 20 are assembled into unity with the first guide plates 13 of the lower base plate 1 in mating relation and then fabric A is passed through gaps defined by the first and second guide plates 13, 29 in the direction of movement X of the fabric A, that is, toward the sewing machine for sewing pin tucks (not shown); and as continuous folds are formed by the first and second fabric folding guide edges 16, 32 of the first and second guide plates 13 . . . , 29 . . . , folds A′ folded in pleated-like pattern are formed.

Figure 8:
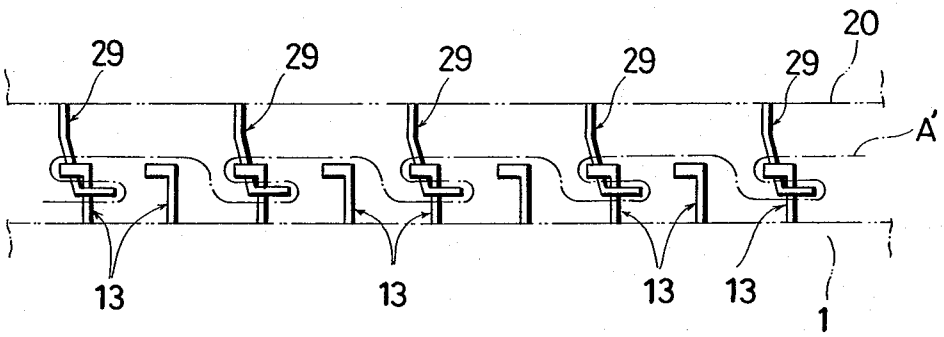
FIGS. 8 and 9 are schematic front views taken on line Z—Z' in the FIG. 7, showing guide plates of the invention arranged in place by way of example.

If it is desired to change the intervals of pleat-like folds A′, some of the second guide plates 29 . . . of the upper base plate 20 should be removed from the front and rear guide plate mounting plates 22, 26 in such a manner that, as FIG. 8 illustrates, second guide plates are thinned out in alternate order. If it is desired to change the needle intervals in the sewing machine for sewing pin tucks it is only necessary to change the front guide plate mounting plates 5, 22 of the lower and upper base plates 1, 20 correspondingly to the change in needle intervals. This is intended to utilize the deformation of first and second guide plate 13, 29 according to the change. Thus, the trouble of parts replacement can be saved considerably.

Figure 9:
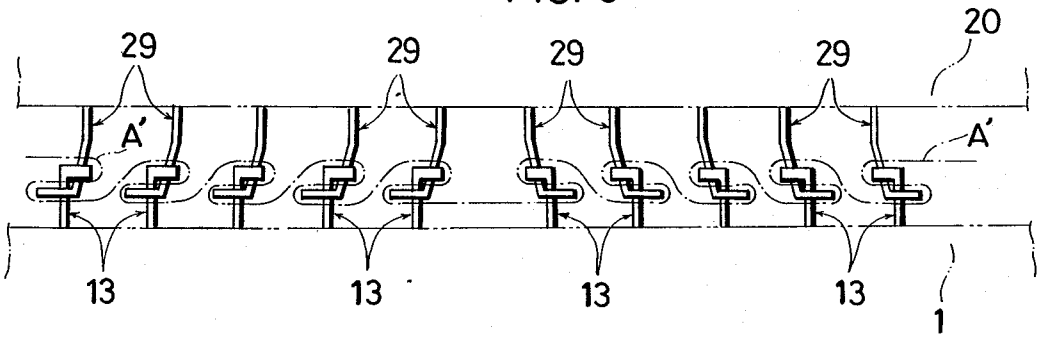

Also, it is possible to freely change the direction of folding a A′ as FIG. 9 illustrates by way of example.

What is claimed is:

1. A pin tucking device in a sewing machine for pin tucks comprising a base plate, front and rear guide plate mounting plates mounted respectively to front and rear edges of the base plate, front and rear fixing plates coupled to and overlaying said first and second guide plate mounting plates and a plurality of guide plate mounting plates and a plurality of guide plates over a space between the front and rear guide plate mounting plates, the front and rear guide plate mounting plates each having a plurality of comb tooth-shaped kerfs spaced from one another in transverse relation to a direction of movement of fabric to be sewn, said front and rear guide plates including a plurality of parallel plate portions provided in parallel to each other and each having a first hook portion which is fitted in one of the kerfs of the front guide plate mounting plate to thereby lock it in position and which is fixed to said front guide plate mounting plate by being pressed thereagainst by said front fixing plate, and a plurality of radial plate portions individually, radially extending at predetermined angles from said parallel plate portions to said rear guide plate mounting plate, said radial plate portions each having a second hook portion which is fitted in one of the kerfs of the rear guide plate mounting plates and thereby locked in position and in which is fixed to said rear guide plate mounting plate by being pressed thereagainst by said rear fixing plate.

2. The pin-tuck device according to claim 1, wherein the base plate comprises upper and lower base plates disposed in opposed relation.

3. The pin-tuck device according to claim 1, wherein the front and rear guide plate mounting plates are each provided with elongated holes and the base plate is provided with threaded holes, said front and rear guide plate mounting plates being mounted on the base plate by the scews inserted into the elongated holes being brought into threaded engaged with the threaded holes in the base plate.

4. The pin-tuck device of claim 2, wherein the front and rear guide plate mounting plates are each provided with elongated holes and the base plates are provided with threaded holes, said front and rear guide plate mounting plates being mounted on the base plates by the screws inserted into the elongated holes being brought into threaded engagement with the threaded holes in the base plate.

* * * * *